United States Patent [19]

Mitchell et al.

[11] Patent Number: 4,493,881

[45] Date of Patent: Jan. 15, 1985

[54] ELECTROPHOTOGRAPHIC METHOD FOR PRODUCING BLACK AND COLOR SEPARATION IMAGES

[75] Inventors: John D. Mitchell, Webster; Stephen Michel, Rochester, both of N.Y.

[73] Assignee: Eastman Kodak Company, Rochester, N.Y.

[21] Appl. No.: 506,255

[22] Filed: Jun. 20, 1983

[51] Int. Cl.[3] ..... G03G 13/01

[52] U.S. Cl. ..... 430/42; 430/31; 430/43

[58] Field of Search ..... 430/42, 43, 31

[56] References Cited

U.S. PATENT DOCUMENTS 4,281,051 7/1981 Sakai ..... 430/42

FOREIGN PATENT DOCUMENTS 54-7339 1/1979 Japan ..... 430/42

OTHER PUBLICATIONS

Schaffert, "Electrophotography", Halsted Press, 1976, pp. 178–183.

*Primary Examiner*—Roland E. Martin

*Attorney, Agent, or Firm*—Torger N. Dahl

[57] ABSTRACT

An electrophotographic method is disclosed for forming a black (or neutral) toner separation image and a color toner separation image from a single original without cross-contamination of black toner in the color separation image and vice versa. The method entails composing an original containing "false-color" information—other than black or neutral—corresponding to the black separation image desired and color information corresponding to the color separation image desired. The false-color and color information are selected to absorb actinic light in mutually exclusive wavelength regions of the spectrum. When the original is illuminated, for example, with light having wavelengths in the false-color absorption region only, a light pattern is formed and employed to expose a charged photoreceptor. The resulting electrostatic image is developed with black—or neutral—toner, thereby forming the black separation image. On the other hand, when the original is illuminated with light of wavelengths in the color information region only, the light pattern produced establishes a different charge pattern when used to expose a charged photoreceptor. The latter charge pattern is developed with a colored toner.

The black and color toner separation images form a composite image without toner cross-contamination when transferred in register to a receiver.

5 Claims, 6 Drawing Figures

ELECTROPHOTOGRAPHIC METHOD FOR PRODUCING BLACK AND COLOR SEPARATION IMAGES

The present invention relates to electrophotographic methods for producing color and black toner separation images from a single original.

Electrophotographic methods and copiers are well-known. In such methods, an original document to be copied is exposed in the copier to light. Some of the information contained in the original document selectively absorbs the light while other information and background reflect or transmit the light, creating thereby an imagewise pattern of light. The imagewise pattern of light is directed to a surface-charged photoconductor causing the charge in those regions of the photoconductor which are light-struck to dissipate, leaving in non-light-struck regions a charge pattern corresponding to the light-absorbing information in the original. The resultant imagewise pattern of charge on the photoconductor is treated with charged electroscopic marking material (referred to in the art as toner) to form a toner image corresponding to the light-absorbing information in the original.

The production of black and white copies from an original is relatively simple. However, in color copying of a multicolor original, separation images are made for each color contained in the original. The formation of separation images corresponding to any color information (other than black or neutral density) involves light exposure of the original through a filter. The filter transmits light of a wavelength which is selectively absorbed by the color information, yet transmitted or reflected by all other regions. Exposure of a charged photoconductor to the transmitted or reflected light, in turn, creates the charge pattern to be developed into the separation image. For example, the imaging process for blue information in an original entails the formation of two color separation images: a first separation image formed with light exposure of the original through a red filter (i.e., a filter which transmits red light), and a second separation image formed with light exposure of the original through a green filter. Light transmitted or reflected in each exposing step is directed toward a charged photoreceptor and the resulting charge pattern after each exposure is developed with cyan and magenta toner respectively to produce the desired blue.

When a multicolor original contains information which is colored black, a mix of colored toners appears in the final copy from the other separation images. If the colored toners are yellow, magenta and cyan, so-called "process" black results. If a high-quality process black image is desired, it is essential that the amount of each color component in the process black be carefully balanced and that the registration of each component be accurate to within close tolerances. If the desired black image, however, is without tonal scale such as in line graphics, process black is usually avoided in view of the strict balance and registration requirements. Instead, copiers can be equipped with a fourth toner station containing black toner which is used with a sequence including exposure, imaging, and toning to form a black toner separation image on the photoconductor. The black separation image is then registered with the other color separation images to form a multicolor copy of the original.

In the production of black toner and color toner separation images from a multicolor original containing black information and color information, special measures must be taken to avoid deposition of unwanted toner in each separation image, a problem referred to as toner cross-contamination.

In the black imaging step, deposition of black toner in colored image areas is avoided by exposing the original to light selectively absorbed by black but not by color information. Because all wavelengths of light are absorbed by black, it is relatively simple to select an appropriate wavelength of light not absorbed by the color information.

In the color imaging step(s), however, contamination by color toner in the black image areas is also a problem. The difficulty stems from the fact that black or neutral colorants absorb light in all wavelengths of the visible spectrum. Accordingly, although light of a given wavelength absorbed by one region of color information and not by another adequately separates such two color information regions, it does not separate black from the desired color. Thus, color toner deposits in the regions of the photoconductor intended for black.

In accordance with the present invention, cross-contamination is avoided by an electrophotographic method for forming a color separation image and a black separation image comprising:

(a) forming an original containing false-color information corresponding to the black separation image desired, and color information corresponding to the color separation image desired, the false-color information being capable of selectively absorbing actinic light in a first wavelength region, $W_1$, of the spectrum, and the color information being capable of selectively absorbing actinic light in a second wavelength region, $W_2$, of the spectrum;

(b) forming a black separation image by:

(i) illuminating the original either with light having wavelengths within the $W_1$ region only, or with light having wavelengths in both the $W_1$ and $W_2$ wavelength regions which is filtered after illuminating the original to exclude all light except that having $W_1$ wavelengths, thereby forming a first pattern of light corresponding to the false-color information;

(ii) exposing a charged first photoreceptor to the first pattern of light to form a first electrostatic image; and (iii) developing the first electrostatic image with a black or neutral toner; and (c) forming a nonoverlapping color separation image by:

(i) illuminating the original either with light having wavelengths within the $W_2$ region only, or with light having wavelengths in both the $W_1$ and $W_2$ wavelength regions which is filtered after illuminating the original to exclude all light except that have $W_2$ wavelengths, thereby forming a second pattern of light corresponding to the color information;

(ii) exposing a charged second photoreceptor to the second pattern of light to form a second electrostatic image; and (iii) developing the second electrostatic image with a colored toner.

By the above method, the color separation image contains no color toner in regions intended for the black (or neutral) toner and vice versa. When the two separation images are transferred in register to a receiving element, such as paper, a composite image is produced with virtually no toner cross-contamination.

In the following discussion, reference will be made to the drawings in which.

THE ORIGINAL

The practice of the invention first entails the preparation of an appropriate original. In the original, the image information contains regions of different spectral absorption. According to the invention, the key to color separating black (or neutral) from other colors lies in false-coloring those regions of the original which form the basis for a black separation image. The false color is selected for its ability to absorb actinic light in a spectral region which is distinct from the region of absorption of the other regions of the image intended as information for color separation images.

Figure 1:
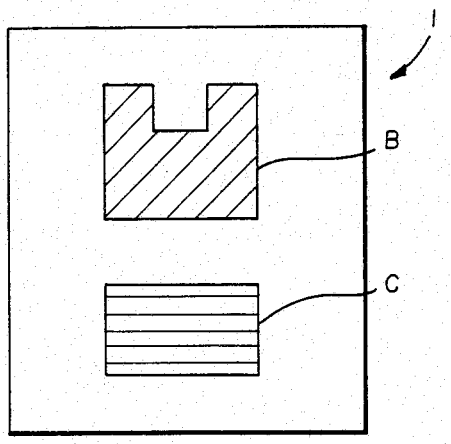
FIG. 1 is a schematic representation of a multicolor original containing false-color and color information.
Figure 2:
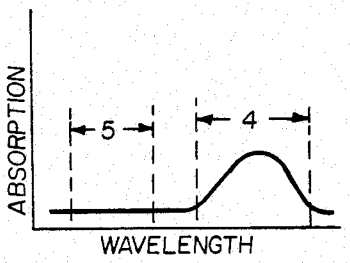
FIGS. 2 and 3 are representations of absorption spectra for areas of the original in FIG. 1.
Figure 3:
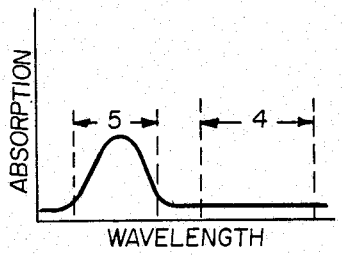

FIGS. 1, 2 and 3 illustrate the point. In FIG. 1, an original 1 is shown having false-color image information area B and color image information area C on support 2 such as paper or film. (For convenience in describing the exposure steps in our process, support 2 will be a transparent film, say, polyethylene terephthalate.) Area B, according to the invention, absorbs actinic light in region 4 of the spectrum as shown in FIG. 2, while area C absorbs actinic light in a different region 5 as indicated by FIG. 3. Thus, for example, if light which has been filtered to include wavelengths in region 4 only illuminates original 1, area B will absorb the filtered light while area C will transmit the filtered light. Likewise, light with wavelengths in region 5 only will be absorbed by area C but be transmitted by area B. In this manner, information for black or neutral is imagewise separated from the color information using one original.

The colorants employed to differentiate the information in the original can vary widely from among a variety of pigments and dyes. For example, yellow, magenta and cyan colorants can be employed as information on the original, one of the colorants being designated the false-color for information corresponding to a black or neutral toner separation image. Preferably, the colorants are materials having sharp absorption maxima in narrow spectral regions, as measured at ½ maximum. For example, absorption widths of from about 20 to about 40 nanometers at ½ maximum helps to prevent overlapping absorption among colorants. Particularly useful colorants are from the squarylium class of dyes having the formula:

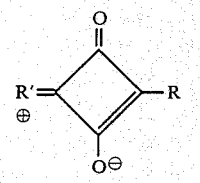

wherein R′ and R are independently nitrogen-containing heterocyclic, aliphatic or aromatic groups.

Representative squarylium dyes and their peak absorption wavelength are shown in Table 1 below.

TABLE 1

| Dye | R′ | R | Peak Absorption |
|---|---|---|---|
| A. | 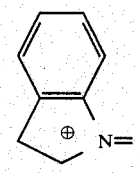 | 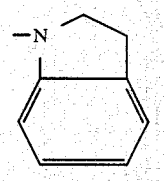 | 438 nm |
| B. | 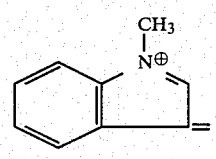 | 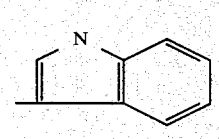 | 554 nm |
| C. | 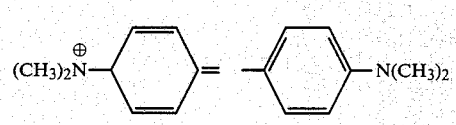 | | 628 nm |
| D. | 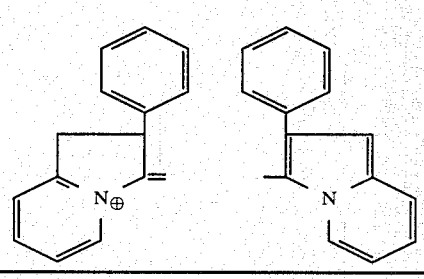 | | 698 nm |

Thus, for example, in the original, any one of dyes A-D can serve as the false-color information for the black separation image while the other dyes can be used as the color information for one or more color separation images. Further details on originals containing squarylium dyes as the original information colors will become apparent in connection with the examples discussed below.

One can also use filters which pass narrow wavelength bands of light to avoid unwanted absorptions during imaging. Alternatively, the use of masking dyes overlaying the original information areas can correct for unwanted absorption.

The Imaging Method

The imaging method comprises the formation of two nonoverlapping separation images—one for black and one for color—using the above-described original. (Additional separation images, colored or neutral density, can also be prepared using other color-separatable information on the original but, for convenience, the process is described for black, or neutral, and one color.) The separation images are formed by exposure of a charged photoconductor followed by development with an electrographic developer.

1. Black Separation Image:

A photoconductor element is provided and charged to a polarity and degree commensurate with the sensitometric parameters of the photoconductor employed. The sensitivity of the photoconductor should extend to all wavelengths of light anticipated in the illumination and exposure steps, particularly to the region 4 and region 5 wavelength regions defined above.

Figure 4:
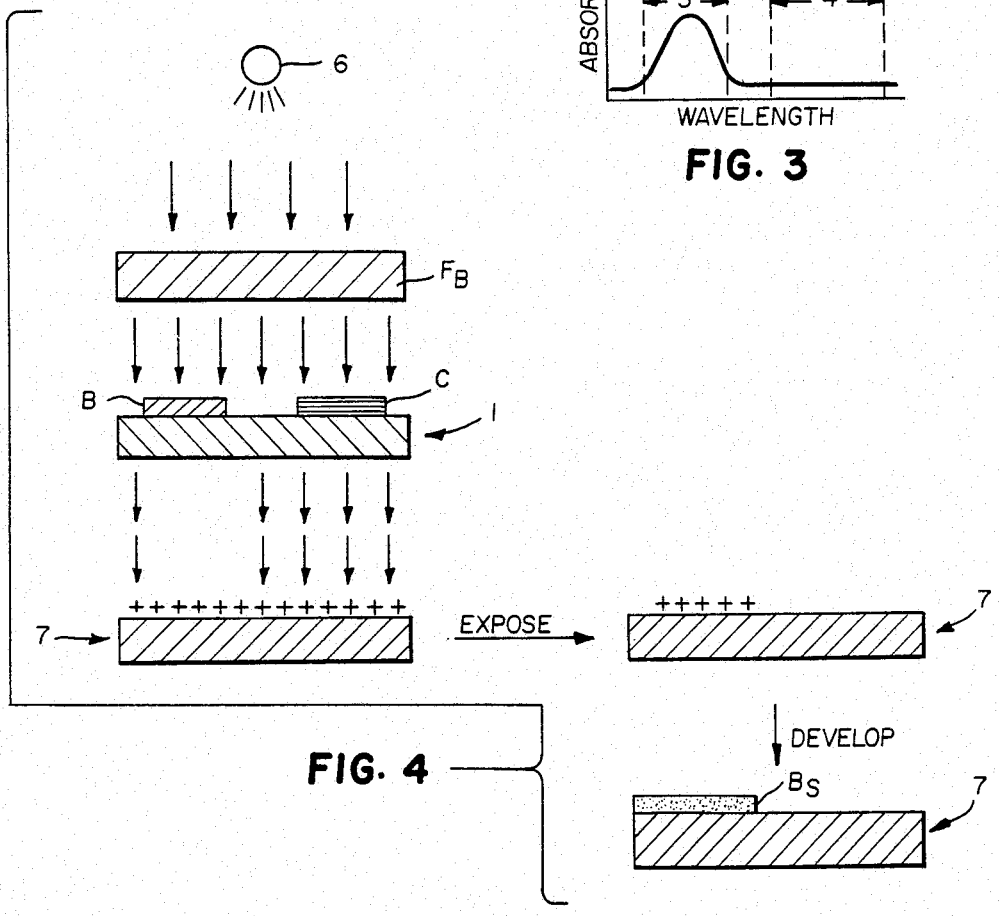
FIG. 4 represents the electrophotographic method of forming a black separation image in accordance with the invention.

Referring to FIG. 4, light from an appropriate source 6 containing wavelengths in regions 4 and 5 passes in sequence through a filter $F_B$ and original 1. Filter $F_B$ is selected so as to transmit light in wavelength region 4 only. Light transmitted by filter $F_B$ and illuminating original 1 will be absorbed in false-color area B but transmitted by the background and color area C, thereby producing a light pattern.

The light pattern produced by original 1 is thereafter employed to expose the charged photoreceptor 7 as shown, thereby creating an electrostatic charge pattern corresponding to the information in false-color area B of the original. Conversely, substantially no charge pattern appears in the areas corresponding to color area C. Thus, when the pattern is developed with a black or neutral toner, an uncontaminated black separation image $B_S$ is obtained.

Figures 5, 6:
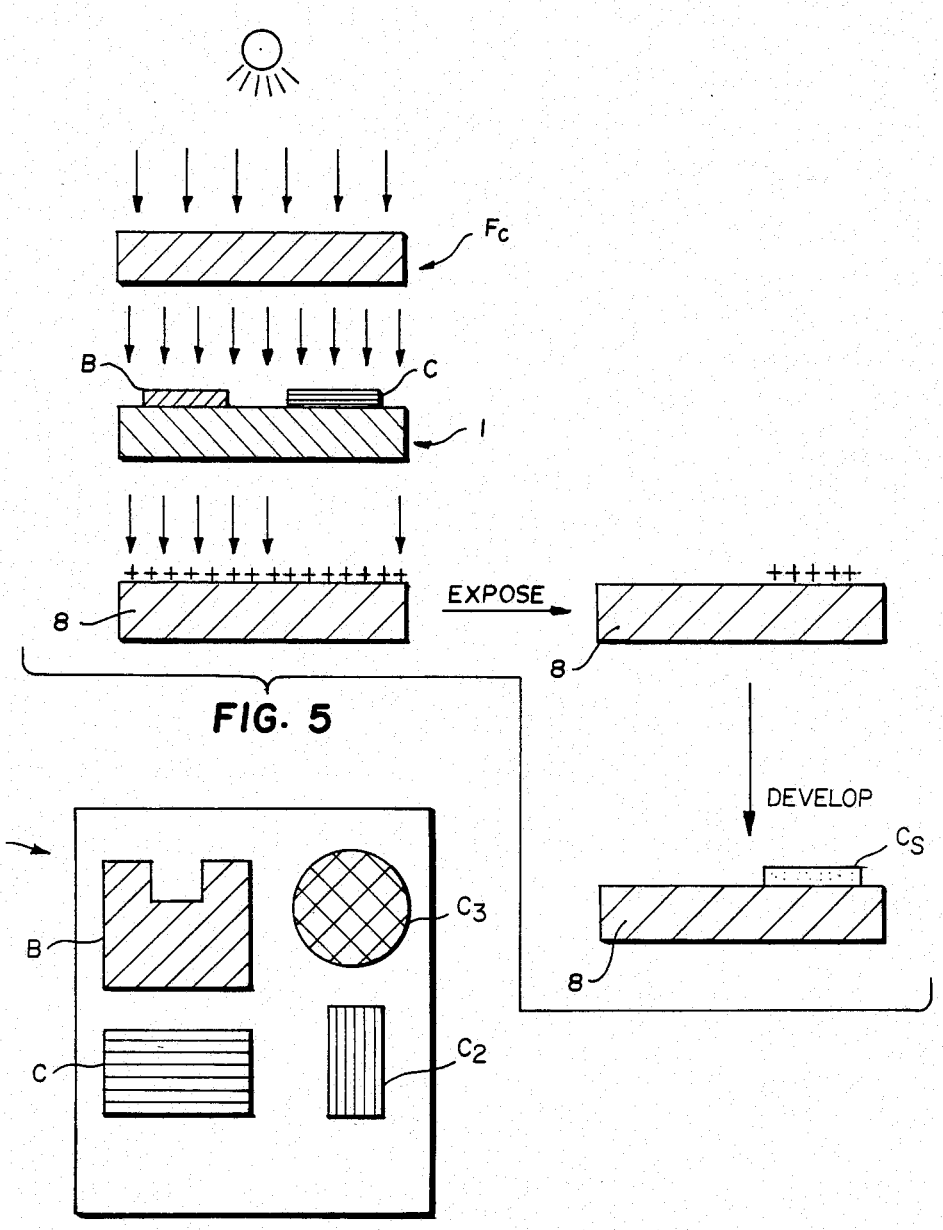
FIG. 5 represents the electrophotographic method of forming a color separation image in accordance with the invention.
FIG. 6 is a schematic representation of multicolor original as in FIG. 1, containing additional regions of color information.

2. Color Separation Image:

As in the steps associated with the black separation image, a light pattern resulting from the illumination of the original is employed to expose a charged photoreceptor. Referring to FIG. 5, light from source 6 is now transmitted in sequence by a filter $F_C$ and original 1. Filter $F_C$ is selected to transmit light in wavelength 5 only. Light transmitted by filter $F_C$ and illuminating original 1 will be absorbed by color area C but transmitted by the background and false-color area B, thereby producing a light pattern.

Thereafter, the light pattern is employed to expose a charged photoreceptor 8 as shown, creating an electrostatic charge pattern corresponding to color area B of the original. Advantageously, no charge pattern appears on the photoreceptor corresponding to false-color area B. This would not have been possible if area B were black or neutral in color. When the charge pattern is developed with a colored toner, an uncontaminated color separation image, $C_S$, is obtained.

Regarding the steps and materials associated with the separation images, several points merit consideration as they relate to alternative modes of performance. For example, the arrangement of filters and the original shown in FIGS. 4 and 5 can be reversed so that light passes through the original first and then through the filter to exclude all but the desired wavelengths of light. The resulting light pattern is the same regardless of the positioning of filter and original in the light path.

The method depicted by FIGS. 4 and 5 entails the transmission of light through the original. It is also possible to employ our original in a reflection mode whereby light illuminating the original is reflected instead of transmitted. It will be appreciated that, in a reflection mode, the original is constructed from an opaque, reflective support.

Furthermore, while FIGS. 4 and 5 depict the use of filters to produce wavelength light from a light source having both region 4 and region 5 wavelengths, one can also employ two different light sources, one having only region 4 wavelength light and the other having only region 5 wavelength light.

The present method is illustrated by the use of two photoreceptors, 7 and 8, respectively. Photoreceptors 7 and 8, in this regard, can be the same or different elements or nonoverlapping regions of the same element. The important consideration is that no two separation images overlap on the photoreceptor. It follows, therefore, that the order of forming the black and color separation images can vary to include either separation image first.

The photoreceptor employed can be selected from many well-known materials. Such materials usually comprise, without limitation, a conductive support onto which is applied a photoconductive layer. We prefer photoreceptors in which the sensitive layers comprise one or more aggregate photoconductive compositions as described in U.S. Pat. No. 3,615,414 to W A Light. Accordingly, the polarity to which the photoreceptor is charged can be either positive or negative depending on the relative efficiency of photodecay which the selected photoreceptor exhibits with respect to either polarity. Preferably, however, the polarity of charge on the photoreceptor is the same in each separation image formation step.

The system and development depicted by FIGS. 4 and 5 is positive-working wherein toner deposits in regions of the photoreceptor correspond to information areas of the original. Negative-working systems are also appropriate by selection of a developer with an appropriate charge polarity. In negative-working systems, the separation image will contain image density corresponding to areas of no density on the original.

The electrostatic charge pattern in each separation image step can be developed in place on the photoreceptor or transferred to a receiving element, such as a paper element, where it is there developed. It is preferred to develop each image on the photoreceptor and thereafter transfer and overlap each separation image in register on a single receiver. The techniques by which either the electrostatic charge patterns or separation images are transferred are disclosed by R. M. Schaffert, *Electrophotography*, 2nd Edition, 1975 (John Wiley and Sons, Inc., New York), Chapter 2 at Section 2.B, Chapter 6 at Sections 6.2–6.5, and Chapter 14.

The present method has been described by reference to two separation images: one in black or neutral and the other in color. Preferably, three or more separation images are formed, in which case additional regions of color information such as $C_2$ and $C_3$ are included in the original 1 as shown by FIG. 6. These additional regions contain dyes or colorants which absorb exclusively in actinic regions of the spectrum other than regions 4 or 5 corresponding to C and B respectively. Hence, in forming color separation images corresponding to $C_2$ or $C_3$, filters which transmit light only in the $C_2$ or $C_3$ absorption regions are employed in a manner analagous to the color separation image formation described above.

The method described above results in one or more color separation images corresponding to one or more color information areas of the original. It has already been noted that the black toner image is keyed to a false color in the original. The color toner images, on the other hand, may or may not be the same in color as their corresponding information areas on the original. For example, one might wish to produce yellow toner in a color separation image from a yellow area on the original using a blue filter. Alternatively, yellow toner can be used to develop the electrostatic image resulting from a green-filtered exposure of a magenta area on the original, and so on for primary colorants and their complements.

Ultimately, it is desirable (although not essential) that all separation images formed be established in overlapping register on a single support. The resulting composite contains color and black (or neutral) toner images without cross-contamination.

The present invention is illustrated by the following examples.

EXAMPLE 1

This example illustrates the formation of a copy comprising black toner text, a red-highlighted paragraph and a gold logo from a single original.

An original element comprising a transparent film support is prepared using cyan as the text color, yellow for the highlighted paragraph and magenta for the logo. The filters employed and the toners employed in each separation image are shown in Table 2 below. In this process, three separation images are formed on three separate photoreceptors, and the resulting images transferred in register to a paper sheet to form the desired copy.

TABLE 2

| Original Information | Filter | Toner Color | Separation Image |
|---|---|---|---|
| cyan text | red | black | black text |
| yellow highlight | blue | red | red highlight |
| magenta logo | green | gold | gold logo |

EXAMPLE 2

This example illustrates how the four squarylium dyes in Table 1 can be used as information for our original to produce three color toner separation images and one black toner separation image. Table 3 shows the relationship of the information on the original to the desired separation image. In this example, four separation images are formed on four separate photoreceptors and the resulting images transferred in register as in Example 1.

TABLE 3

| Original Information | Filter Pass-Wavelength | Toner Color |
|---|---|---|
| Compound A | 438 nm | black |
| Compound B | 554 nm | yellow |
| Compound C | 628 nm | magenta |
| Compound D | 698 nm | cyan |

If the original, moreover, contains areas which are colored with two of the dyes, say dye C and dye D, two otherwise identical magenta and cyan toner separation images will be produced in separate steps corresponding to the information area containing C and D. When the identical separation images are transferred in register to a paper element, the magenta and cyan will overlap to produce a blue image. Of course, the order of development indicated by Table 3 is not essential and may be altered to suit the users's needs.

Although the invention has been described in considerable detail with particular reference to certain preferred embodiments thereof, variations and modifications can be effected within the spirit and scope of the invention.

We claim:

1. An electrophotographic method for forming a color separation image and a black separation image comprising:

(a) providing an original containing false-color information corresponding to the black separation image desired, and color information corresponding to the color separation image desired, the false-color information being capable of selectively absorbing actinic light in a first wavelength region, $W_1$, of the spectrum, and the color information being capable of selectively absorbing actinic light in a second wavelength region, $W_2$, of the spectrum;

(b) forming a black separation image by:

(i) illuminating the original either with light having wavelengths within the $W_1$ region only, or with light having wavelengths in both the $W_1$ and $W_2$ wavelength regions which is filtered after illuminating the original to exclude all light except that having $W_1$ wavelengths, thereby forming a first pattern of light corresponding to the false-color information;

(ii) exposing a first photoreceptor charged to a given polarity to the first pattern of light to form a first electrostatic image of said polarity; and (iii) developing the first electrostatic image with a black or neutral toner; and (c) forming a nonoverlapping color separation image by:

(i) illuminating the original either with light having wavelengths within the $W_2$ region only, or with light having wavelengths in both the $W_1$ and $W_2$ wavelength regions which is filtered after illuminating the original to exclude all light except that having $W_2$ wavelengths, thereby forming a second pattern of light corresponding to the color information;

(ii) exposing a second photoreceptor charged to the same polarity as said first photoreceptor to the second pattern of light to form a second electrostatic image of said polarity; and (iii) developing the second electrostatic image with a colored toner.

2. The method of claim 1 wherein said black and color separation images are transferred in register to a receiver element.

3. The method of claim 1 wherein said first and second photoreceptors comprise portions of a continuous web photoreceptor.

4. The method of claim 1 wherein said first and second photoreceptors are discrete elements.

5. An electrophotographic method for forming a color separation image and a black separation image comprising:

(a) forming on a transparent substrate an original containing false-color information corresponding to the black separation image desired, and color information corresponding to the color separation image desired, the false-color information being capable of selectively absorbing actinic light in a first wavelength region, $W_1$, of the spectrum, and the color information being capable of selectively absorbing actinic light in a second wavelength region, $W_2$, of the spectrum;

(b) forming a black separation image by:

(i) illuminating the original with light having wavelengths in both the $W_1$ and $W_1$ wavelength regions which is filtered after passing through the original to exclude all light except that having $W_1$ wavelengths, thereby forming a first pattern of light corresponding to the false-color information;

(ii) exposing a charged first photoreceptor to the first pattern of light to form a first electrostatic image; and (iii) developing the first electrostatic image with a black or neutral toner; and (c) forming a nonoverlapping color separation image by:

(i) illuminating the original with light having wavelengths in both the $W_1$ and $W_2$ wavelength regions which is filtered after passing through the original to exclude all light except that having $W_2$ wavelengths, thereby forming a second pattern of light corresponding to the color information;

(ii) exposing a charged second photoreceptor to the second pattern of light to form a second electrostatic image; and (iii) developing the second electrostatic image with a colored toner.

* * * * *